US008740172B2

(12) United States Patent
Essrig

(10) Patent No.: US 8,740,172 B2
(45) Date of Patent: Jun. 3, 2014

(54) ANTI-TIPOVER AND SEISMIC SECUREMENT SYSTEM

(76) Inventor: Michael Essrig, San Diego, CA (US)

( * ) Notice: Subject to any disclaimer, the term of this patent is extended or adjusted under 35 U.S.C. 154(b) by 120 days.

(21) Appl. No.: 13/176,388

(22) Filed: Jul. 5, 2011

(65) Prior Publication Data

US 2012/0001050 A1 Jan. 5, 2012

Related U.S. Application Data

(60) Provisional application No. 61/361,298, filed on Jul. 2, 2010.

(51) Int. Cl.
*A47B 97/00* (2006.01)

(52) U.S. Cl.
USPC ..... 248/500; 248/505; 248/313

(58) Field of Classification Search
USPC ..... 248/505, 506, 507, 500, 313, 223.41, 248/501, 232, 228.8, 230.8, 229.17; 52/713, 513, 565, 562, 506.01, 506.02, 52/563; 297/482; 312/245, 351.11, 111
See application file for complete search history.

(56) References Cited

U.S. PATENT DOCUMENTS

| | | | | |
|---|---|---|---|---|
| 2,877,976 | A * | 3/1959 | Massari | 248/313 |
| 4,325,529 | A * | 4/1982 | Seebinger | 248/218.4 |
| 4,341,029 | A * | 7/1982 | Heard | 40/607.12 |
| 5,887,836 | A * | 3/1999 | Back | 248/221.11 |
| 6,796,099 | B1 * | 9/2004 | Georges et al. | 52/699 |
| 7,156,353 | B2 * | 1/2007 | Kringel et al. | 248/311.2 |
| 7,344,116 | B2 * | 3/2008 | Ficarra et al. | 248/311.2 |

* cited by examiner

*Primary Examiner* — Nkeisha Smith
(74) *Attorney, Agent, or Firm* — Donn K. Harms

(57) ABSTRACT

A tipover prevention and seismic securement system for securing furniture and appliances from tipping over. The system employs a pair of identical mounts which are engaged to surfaces of the device to be secured and the securing position. A planar belt having apertures therein provides a tether between the two mounts through an engagement with projections on the mounts and apertures in the belt. Translating members secure the belt in its engagement to the mounts. The translating members once engaged must be unlocked to allow removal thereof and subsequent removal of the belt.

5 Claims, 4 Drawing Sheets

ANTI-TIPOVER AND SEISMIC SECUREMENT SYSTEM

BACKGROUND OF THE INVENTION

1. Field of the Invention

This application claims priority to U.S. Provisional Application Ser. No. 61/361,298, filed on Jul. 2, 2010, and is incorporated in its entirety by reference herein.

The present invention relates to the stabilization of objects such as furniture, electronics and appliances. More particularly it relates to a securement system for preventing the toppling and/or migrating of objects such as file cabinets, furniture, electronic equipment and the like, should they become top heavy or unbalanced during use, climbed upon by children, or should they be subjected to the forces of a seismic event such as an earthquake.

2. Background of the Invention

Securing objects from toppling and from position-migration has, in recent years, become the subject of much attention and recommendation by government and industry officials with regard to emergency prevention and management. Studies have shown that people, especially children, can be severely injured by common household objects should they topple over. While residents of earthquake prone areas are aware of this and generally take steps to prevent toppling of large objects such as file cabinets, big screen televisions, dressers, and the like, this is not the case in areas of the country not prone to seismic events. However, such large and top heavy objects are just as easily toppled by mis-loading or mis-use as by an earthquake. A large bookcase or top heavy dresser falling on a child can cause significant injury or death. This easily occurs when upper drawers are opened on a dresser or file cabinet and then leaned upon or when children climb upon furniture during play.

In the case of earthquakes, the threat of toppling of furniture and expensive electronics is increased due to movement of floors in homes and offices. Should the furniture or appliance or other large object be top heavy from loading or from its basic design, seismic movements generated by an earthquake increase the risk of the object tipping over resulting in possible injury to occupants of the building. Further, even if large or expensive items and equipment do not topple during an earthquake, they are still prone to position-migration due to the floor surface movement during a seismic event. Such movement can cause other damage or cause items supported by a migrating piece of furniture to topple.

It is the realization that injury and death can result from tip-overs during use, and toppling and object migration during earthquakes, which have caused concerned people and businesses to undergo retrofits of property to secure objects and expensive items inside a building to enhance household and business seismic safety. Such securement may include the engagement of furniture, refrigerators, water heaters and breakables to the walls to prevent movement.

Numerous devices and methods have been introduced to the market in recent decades to address the dilemma of movement of objects and furniture. All such systems can be hard to install and are easily installed backwards where they may not function correctly. For example, U.S. Pat. No. 7,175,149 (Gallien) teaches the use of a flexible cable engaged to mounts using removable pins. However, this patent is subject to the correct sizing of the length of the cable by the user and resulting problems should it be cut too long. Further, it is not particularly aesthetic and therefor is less likely to be employed by some home or business users.

U.S. Pat. No. 6,220,562 (Konkle) teaches a securement system which employs wall mounts and object mounts secured by a zip-tie or quick-tie device. However, Konkle by employing such a zip-tie, limits the engagement there to a single use whereafter another tie must be employed. Further, the mounts have edges that could be prone to cut the plastic tie during a sharp movement of the object and the plastic in the tie itself can be affected by sunlight over time.

Another teaching is that of U.S. Pat. No. 5,599,000 (Bennett) which secures objects to walls and the like using a flexible strap engageable with mounts. Bennett, however, employs a plastic strap which can be severely weakened by UV sunlight. Further, the mount engagements to the strap can be engaged backwards if the user is not paying attention.

As such, there is a continuing unmet need for an improved object securement device and system which will more effectively provide a means to secure large ungainly objects to maintain their position during seismic events as well as when they become top heavy. Such a device should be easily engaged to both the object and the support and be aesthetically pleasing to encourage use. Such a device should be easily understood and employed during installation by professional and household users alike, such that it cannot be installed backwards or improperly. Finally, such a device should employ both mounts and a securement between them, which will maintain its strength after exposure to sunlight, and is easily adjusted to a proper length to secure the object in question without expensive tools.

SUMMARY OF THE INVENTION

The disclosed device and method herein, features a device and method for securing objects to static structural elements to prevent toppling or migration of the object in the room during use or upon a seismic event. Widespread use is encouraged since the device is easy to install properly and aesthetically pleasing once installed.

The disclosed device features first and second mounts which are substantially identical whereby the user cannot be easily confused as to which mount is placed where. The first mount is employed as a structural mount which is adapted for engagement to the securing wall or other static mounting position using means of engagement to the structure such as fasteners, screws, nails, adhesive or other means of engagement that would occur to those skilled in the art. The second mount is engaged to the object being restrained and employs means of engagement adapted to that purpose which may vary depending upon the size and the weight of the object being restrained. In most cases, adhesive may be employed since users will hesitate to employ mechanical fasteners such as screws with furniture or electronic equipment as they could damage it.

Between the first and second mounts is engaged a planar connecter strap. The planar connector strap is of a width adapted to engage within slots formed on both the first and second connectors and has a continuous series of apertures formed through the strap which are sized and spaced to engage upon projections rising from the surface of the mounts in-between shoulders defining the slots. The apertures slidably engage upon at least one projection and preferably a plurality of them spaced apart substantially equal to the spacing of the apertures in the strap.

Means to prevent removal of the engagement of the connector strap from the connectors is provided by planar members adapted to engage with the connectors to an engaged position which positioned opposite the surface of the connectors from which the projections extend. Thus, the slot formed between the two shoulders of the connecter surrounds the engaged strap when the device is in an as-used position, with the connectors engaged to an object and a structural surface, and the strap engaged between the connectors.

The strap is preferably formed of webbing material similar to that of a seat-belt and coated with a plastic or similar coating. The coating is adapted to resist UV light degradation and thereby protect the underlying webbing which provides great strength to the connection between the two connectors. Of course, those skilled in the art will realize that other planar materials such as leather, plastic, fiberglass tape, or the like might be employed, and such is anticipated within the scope of this patent. However, due to the high tensile strength afforded by webbing and the UV inhabitancy provided by a vinyl or plastic coating thereon with appropriate inhibitors therein, a coated webbing material is preferred.

In the webbing material are formed a plurality of apertures substantially equidistantly spaced and communicating through both side surfaces of the strap. The apertures are continuous from a first to second end of the strap. Since preferably a plurality of projections on the mounts engage a plurality of the apertures, the centerline spacing of the apertures is substantially identical to that of the projections.

The device is provided as a kit of parts including the two mounts, the two engaging planar members and a length of strap for engagement therebetween. The user may easily engage the two mounts to their respective positions using appropriate means of attachment. Thereafter the strap is engaged by placing the apertures on the strap end upon the projections on the mounts and cutting off any excess. Thereafter, the planar member is slid into position and a locking component passively engages with the mount to maintain the planar member in position with one surface abutting the distal ends of the projections to prevent the strap from disengaging until the planar member is removed.

With respect to the above description, before explaining at least one preferred embodiment of the restraint system herein, in detail, it is to be understood that the invention is not limited in its application to the details of operation nor the arrangement of the components or steps set forth in the following description or illustrations in the drawings. The various methods of implementation and operation of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other devices for restraining objects from tipover or migration. It is important, therefore, that the objects and claims be regarded as including such equivalent construction and methodology insofar as they do not depart from the spirit and scope of the present invention.

It is an object of this invention to provide a restraint system for large objects from toppling or movement during use or a seismic event.

It is an object of this invention to provide such a restraint which employs an easily engaged and disengaged lanyard or strap between the object and the mounting structure.

It is another object of this invention to provide such a restraint which is easy to understand and install properly and thereby prevent mis-installations.

Yet another object of the device is the provision of an aesthetically pleasing device to encourage use and a connector strap which is inhibited from UV damage and has great tensile strength.

These together with other objects and advantages which become subsequently apparent, reside in the details of the construction and operation of the disclosed object restraint system herein as more fully hereinafter described and claimed, reference being had to the accompanying drawings forming a part thereof, wherein like numerals refer to like parts throughout. Further objectives of this invention will be brought out in the following part of the specification wherein detailed description is for the purpose of fully disclosing the invention without placing limitations thereon.

BRIEF DESCRIPTION OF DRAWING FIGURES

FIG. 1 depicts a perspective view of one connector of the device engaged with a connector strap and a planar self-locking member engageable with the mount.

FIG. 2 top plan view of a mount of the device.

DETAILED DESCRIPTION OF THE PREFERRED EMBODIMENTS OF THE INVENTION

Figure 1:
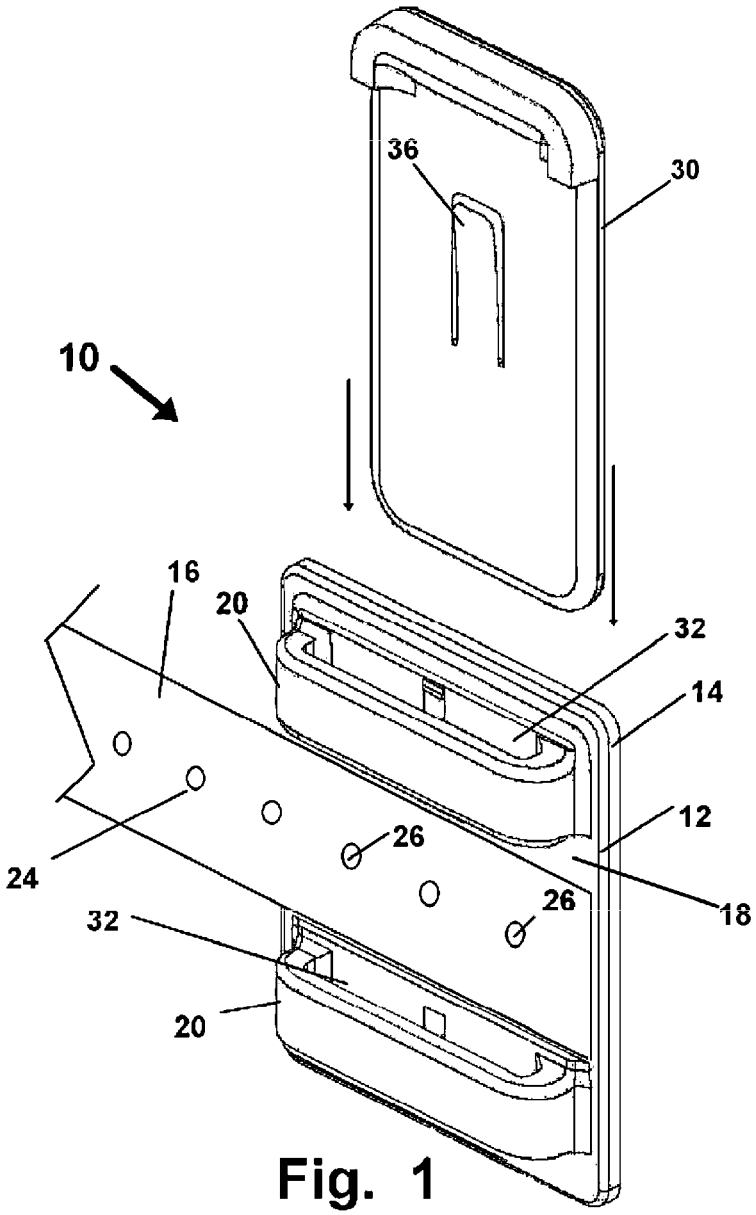
Figure 2:
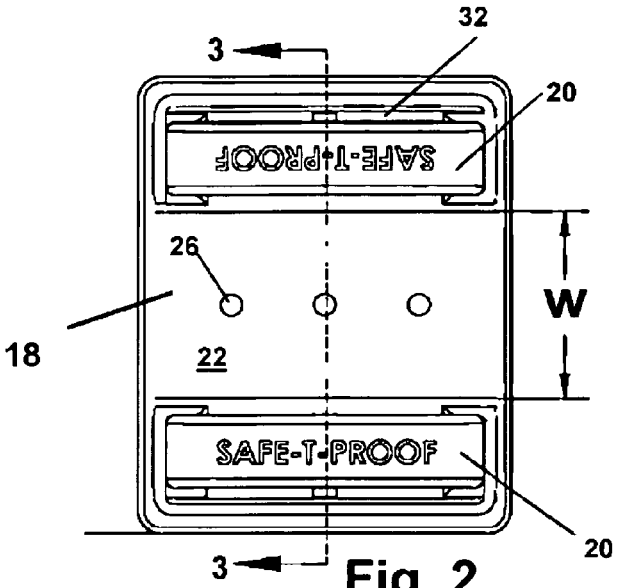
Figure 3:
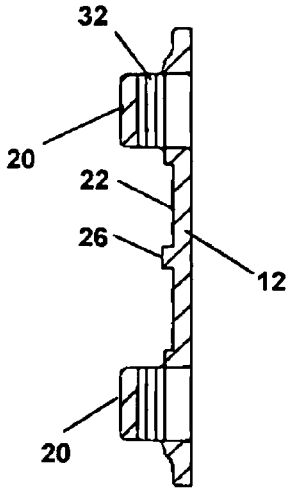
FIG. 3 shows a sectional view of the mount along line 3-3 of FIG. 2
Figure 4:
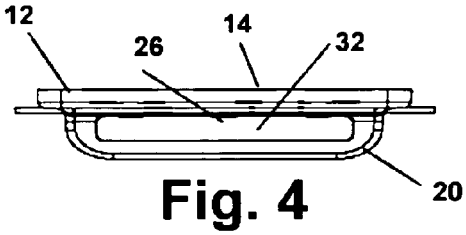
FIG. 4 is an end view of the mount of FIG. 1 showing an aperture adapted to engage with the planar member of FIG. 1.

Referring now to the drawings of FIGS. 1-10, in FIG. 1 is shown a perspective view of the components making up the disclosed device 10 herein. The same mount 12 is employed on both the static mounting surface of the building such as a wall, and upon the object being restrained. Thus the device 10 employs two substantially identical mounts 12 whereby the user is not confused as to which goes where.

A first mount 12 of the pair, is engageable to the securing wall or other static mounting position of a structure housing the object to be restrained. Means of engagement to the structure can be one or a combination of fasteners including screws, nails, and adhesive 14 in the form of a peel an stick pad pre-engaged to the mount 12, or other means of engagement that would occur to those skilled in the art.

The second mount 12 of the pair, is engaged to the object being restrained and means of engagement adapted to that purpose which as noted above, may vary depending upon the size and the weight of the object being restrained. In most cases adhesive 14 in the same form as that of the first mount 12 is preferred. This is to avoid any user hesitation to employ the device 10 which might arise should it employ mechanical fasteners such as screws which could harm furniture or internal electronic components depending on the object being restrained.

A secure communication is provided between the first and second mounts 12 using a novel flexibly planar connecter strap 16. The planar connector strap 16 is of a width "W" on FIG. 2, configured to engage within slot 18 on the connectors 12 between two arches rising above a first surface 22 and forming shoulders on the connectors 12. The flexible strap 16 has a continuous series of apertures 24 formed through the strap 16 each of which is sized and spaced to engage upon projections 26 rising from the first surface 22 of the mounts 12 in-between shoulders 20 defining the slots 18. The apertures 24 slidably engage upon at least one projection 26 and preferably a plurality of projections 26 each spaced apart substantially equal to the spacing of the apertures 24 in the strap 16. The strap 16 is formed of a high tensile material yet flexible such as vinyl or neoprene coated webbing similar to that used for seat belts in a car.

Means to prevent unintentional removal of the engagement of the connector strap 16 apertures 24 from the projections 26 extending from the connectors 12, is provided by planar member 30 which is sized to engage a passage 32 formed in the connectors 12 which communicates through both arches forming the shoulders 20. The device 10 and the connectors 12 cannot be assembled backwards as with other securement devices because the planar member 30 will engage with the connector 12 from either direction through either shoulder 20 into the passage 32. This makes it very easy for a user to install and use without worry of doing it wrong.

Figure 7:
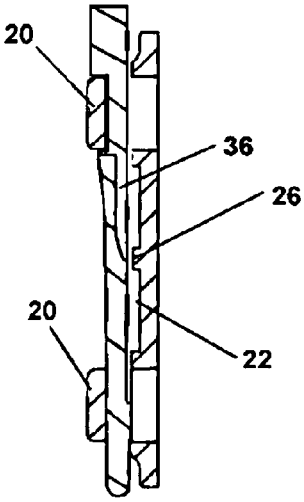
FIG. 7 shows a sectional view of the planar member of FIG. 6 engaged with the section of the mount of FIG. 3 and the locking projection preventing unintentional removal.
Figure 6:
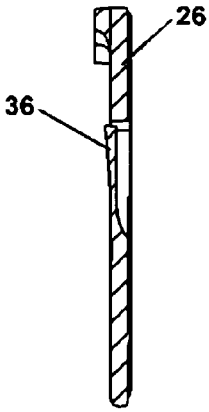
FIG. 6 is a sectional view though FIG. 5 along line 6-6 and showing the biased locking projection configured to engage with the mount and prevent accidental removal.
Figure 5:
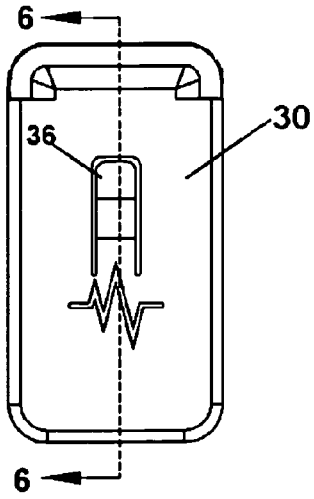
FIG. 5 is a top plan view of the planar member with biased locking projection.
Figure 9:
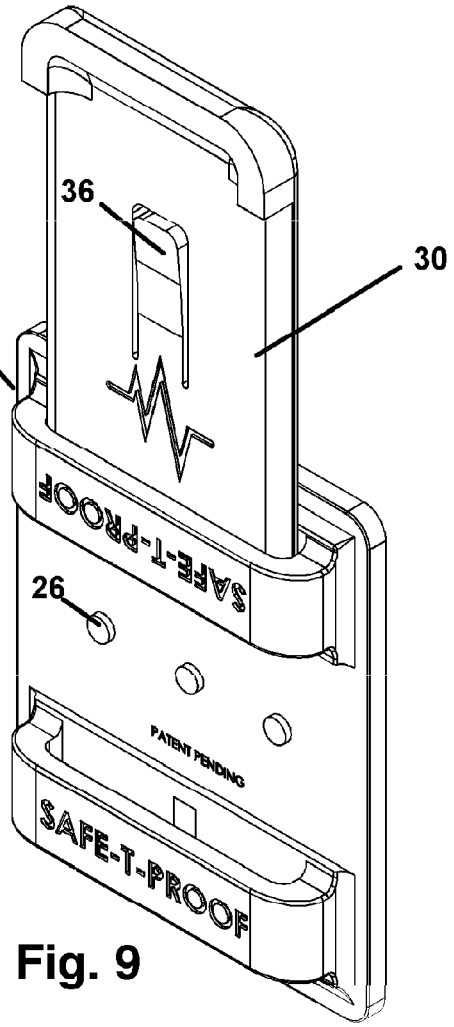
FIG. 9 depicts the device of FIG. 1 and FIG. 8 with the planar member engaged in the pathway formed under the two arched shoulders of the mount.

Inserted into the passage 32 through either shoulder 20 to an engaged position as shown in FIG. 7 and FIG. 9, the planar member 30 is restrained therein and prevented from unintentional removal by a biased locking member 36 which rises and abuts against one of the shoulders 20, when the planar member 30 is in the engaged position. This is most important as it prevents unintentional removal of the planar member 30 and thereby unintentional removal of the strap 16 from the mount 12.

As noted, the strap 16 herein is preferably formed of webbing material, similar to that of a seat-belt and preferably is coated with a plastic or similar coating. This coating is formulated to resist UV light degradation and thereby protect the underlying webbing which provides great strength to the strap 16 for the connection between the two connectors 12. The vinyl or similar coating provides a means to prevent the fabric forming the underlying webbing, from fraying at the apertures 24 when cut. Other planar materials such as leather, plastic, or fiberglass tape, or the like might be employed for the strap 16 however due to the high tensile strength afforded by webbing and the UV inhabitancy provided by a vinyl or plastic coating thereon, and the fact that the device 10 will be installed long term and exposed to light for perhaps years, the vinyl coated webbing is preferred. Just like the planar member 30 is insertable from either side, so too is the strap 16 providing the tether between the two mounts 12.

The device 10 may be provided as a kit of parts including the two mounts 12, the two engaging planar members 30 and a length of strap 16 for engagement therebetween.

Figure 8:
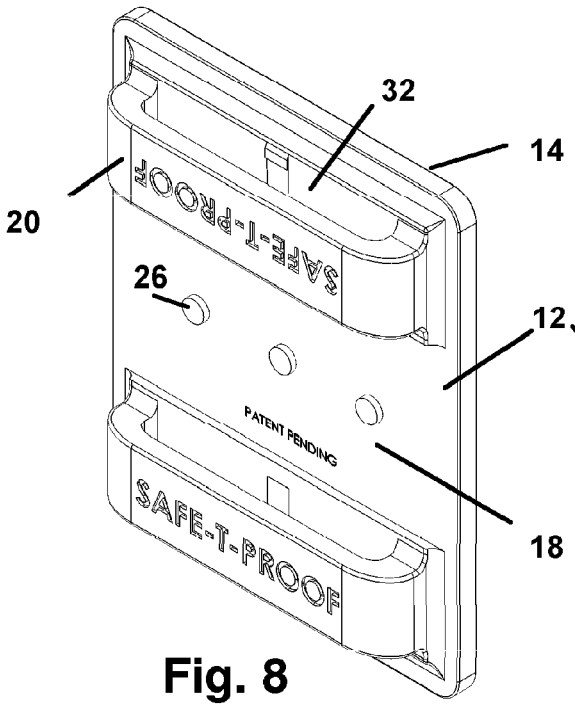
FIG. 8 is a perspective view of the mount of FIG. 1 showing the slot between the two arched shoulders.

In FIG. 8 there is seen a perspective view of the mount 12 of FIG. 1 showing the slot 18 and projections 26 positioned in a spacing equal to the spacing of the apertures 24 in the strap 16.

FIG. 9 depicts the device of FIG. 1 and FIG. 8 with the planar member 30 engaged in the passage 32 formed under the two arched shoulders 20 of the mount 12.

Figure 10:
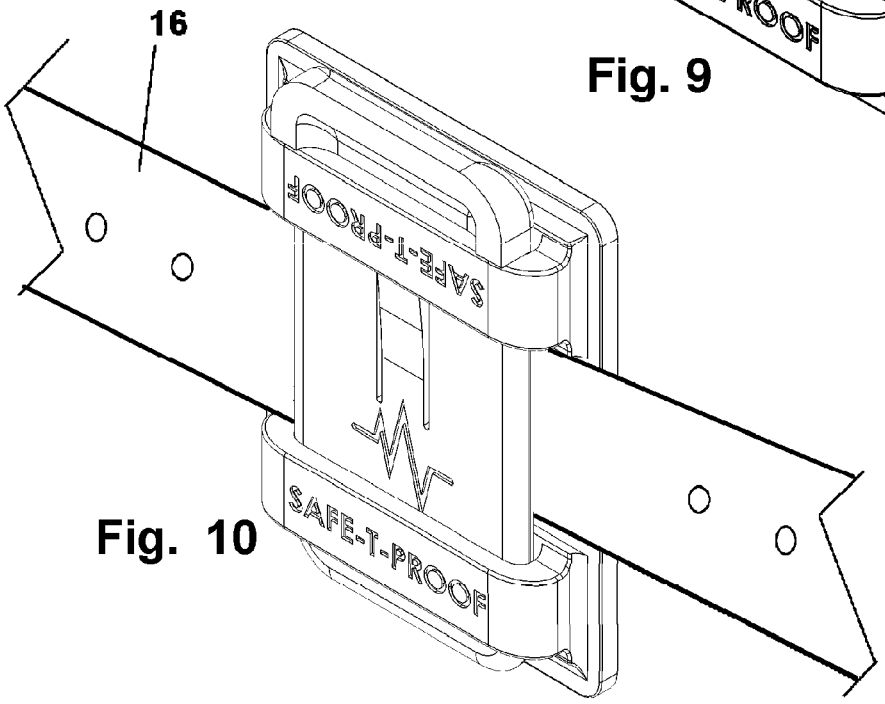
FIG. 10 depicts the device with the strap engaged and the planar member in an engaged position with an inside edge abutting the strap and maintaining it from removal from the projections in the registered engagement with the apertures.

FIG. 10 depicts the device 12 with the strap 16 engaged and the planar member 30 in an engaged position with an inside edge abutting the strap 16 and maintaining it from removal from the projections 26 which are spaced equal to the apertures 24 to provide a registered engagement with the apertures 24. FIG. 10 is representative of the two mounts of the device 10 as they would be installed on a piece of furniture and a wall with the same mount engaged on both surfaces and the strap 16 acting as a tether therebetween.

Figure 11:
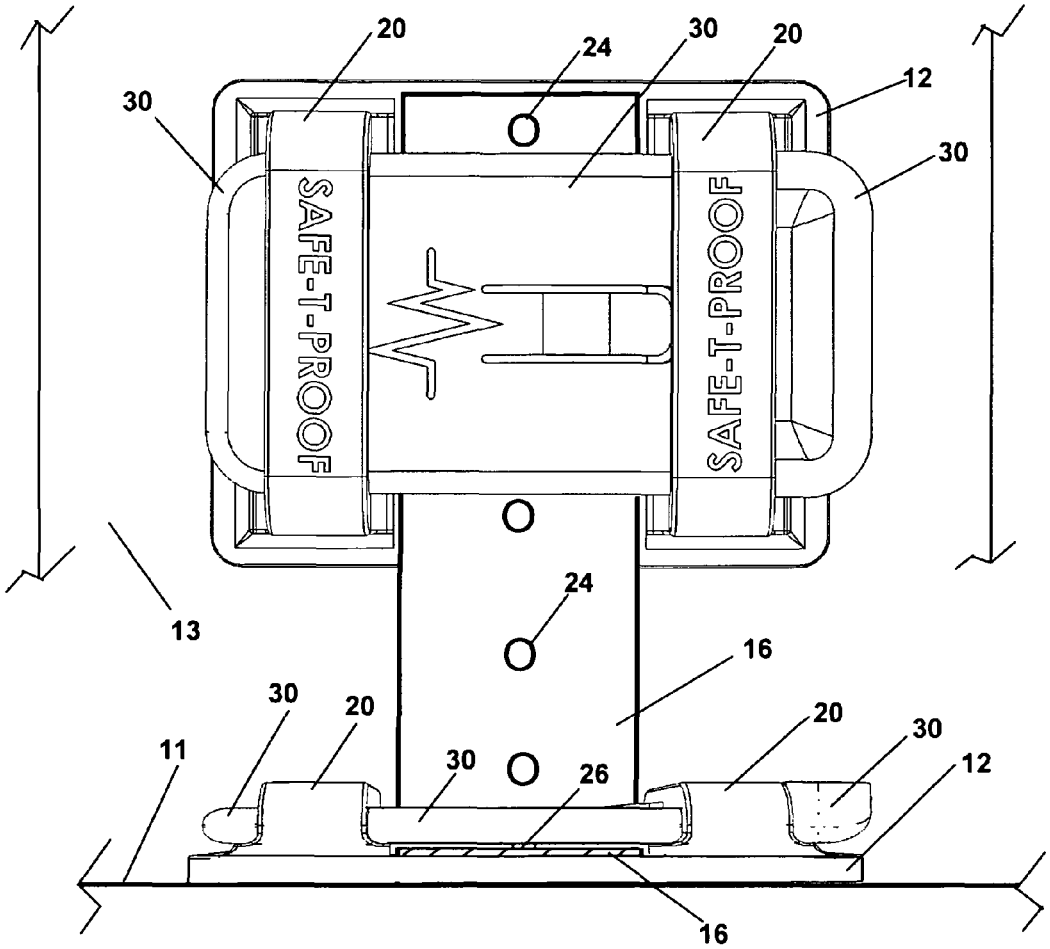
FIG. 11 depicts an article being secured from tipping by a first mount engaged to a securement position and a second mount engaged to the article being secured, and having a tether engaged between the first and second mounts.

FIG. 11 depicts an article 11 being secured from tipping by a first mount 12 engaged to a securement position 13 such as a wall, and a second mount 12 engaged to the article 11 being secured, and showing a strap 16 providing a tether engaged between the first and second mounts 12. Planar members 30 are shown in respective engaged positions with each mount 12 with an inside edge abutting the strap 16 an maintaining the apertures 24 formed in the strap 16, engaged upon the projections 26 upon each mount 12.

While all of the fundamental characteristics and features of the disclosed restrain system for objects to prevent toppling or migration in position have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A tipover prevention and seismic securement system, comprising:

a mount, one each of said mount engageable to both of an article to be secured from tipping, and a securement position;

means for engagement of each of said mounts to respective engaged positions upon said article and said securement position;

said mount having a pathway therethrough between two shoulder portions;

a tether, said tether sized to engage through said pathway in each of said mounts;

means for removable securement of said tether, to a surface of said pathway;

a planar member, said planar member slidingly engageable through a passage formed in each of said shoulders in a direction traverse to said pathway;

said planar member having an engaged position with a portion thereof within said passage of each of said shoulders;

said planar member in said engaged position having a bottom surface having a position adjacent to said tether and providing means to maintain said tether engaged to said means for removable securement and whereby a respective one each of said mounts engaged to said article and said securement position with said tether engaged therebetween, will provide means to prevent said article from tipping over.

2. The tipover prevention and seismic securement system of claim 1 wherein said means for removable securement of said tether, to a surface of said pathway comprises:

said tether being a planar belt having a width sized to engage in said passage;

said belt having a plurality of apertures therein, each spaced a substantially equal distance from adjacent apertures;

a surface of said passage having a plurality of projections rising therefrom, said projections having a diameter substantially equal to a diameter of said apertures;

said projections spaced from adjacent projections a distance substantially equal to said distance of said apertures; and said belt removably engageable to said mount by an engagement of a plurality of said apertures upon a plurality of said projections.

3. The tipover prevention and seismic securement system of claim 2 additionally comprising releasable means for prevention of removal of said planar member from said engaged position whereby said strap is maintained with said apertures in said engagement with said projections until said prevention of removal of said planar member is released.

4. The tipover prevention and seismic securement system of claim 3, wherein said releasable means for prevention of removal of said planar member from said engaged position comprises:

a flexible projection rising above a top surface of said planar member opposite said bottom surface;

said passage formed in said shoulders defined by an interior wall surface extending to opposing side edges of said shoulders;

said projection extending past said interior wall surface to a position intersecting said side edges; and said projection depressable into said planar member to a position intersecting said interior wall and out of line of said side edges whereby said planar member may be translated out of said position adjacent to said tether.

5. The tipover prevention and seismic securement system of claim 4 additionally comprising:

said planar member insertable to said engaged position in either direction whereby said planar member may be inserted in a direction from a first of said shoulders toward a second of said shoulders or in a direction from said second of said shoulders toward said first of said shoulders.

* * * * *